US006185392B1

(12) United States Patent
Hoshi

(10) Patent No.: US 6,185,392 B1
(45) **Date of Patent: *Feb. 6, 2001**

(54) DEVELOPING APPARATUS

(75) Inventor: Nobuharu Hoshi, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/361,967

(22) Filed: Jul. 28, 1999

(30) Foreign Application Priority Data

Aug. 4, 1998 (JP) ..... 10-220203

(51) Int. Cl.[7] ..... G03G 15/08
(52) U.S. Cl. ..... 399/102; 399/103
(58) Field of Search ..... 399/102, 103, 399/105, 106

(56) References Cited

U.S. PATENT DOCUMENTS 5,057,868 * 10/1991 Sekino et al. ..... 399/105
5,134,960 * 8/1992 Shirai ..... 399/105
5,655,178 * 8/1997 Ishikawa et al. ..... 399/103
5,790,923 * 8/1997 Oguma et al. ..... 399/105

OTHER PUBLICATIONS

U.S. application No. 09/290,265, filed Apr. 13, 1999, pending.*

* cited by examiner

*Primary Examiner*—William Royer
*Assistant Examiner*—Remmon R. Forde'
(74) *Attorney, Agent, or Firm*—Fitzpatrick, Cella, Harper & Scinto

(57) ABSTRACT

The present invention is featured that a developing apparatus has an elastic member provided on a side of a leakage preventing member which is supported by a developing container, and that the elastic member is provided so as to overlap an overlapping portion between the leakage preventing member and a developer regulating member on an end portion in a lengthwise direction of the developing container.

4 Claims, 3 Drawing Sheets

DEVELOPING APPARATUS

BACKGROUND OF THE INVENTION

1. Field of the Invention

This invention relates to a developing apparatus for use in an image forming apparatus such as a copying apparatus, a printer or a facsimile apparatus.

2. Related Background Art

A color laser printer will be exemplified and briefly described as a conventional electrophotographic image forming apparatus. The surface of an electrophotographic photosensitive body uniformly charged by a primary charging device is exposed by the condensing of a laser corresponding to an image signal by a scanner portion and an electrostatic latent image of each color is formed thereon.

A developing device is disposed at a location opposed to the electrophotographic photosensitive body and at this location, a developing sleeve which is a developer bearing body is positioned so as to be opposed to the surface of the electrophotographic photosensitive body with a minute interval secured therebetween. During image formation, the high voltage source of the main body of the apparatus is connected to the developing sleeve of the developing device and a bias is applied to the latter. At the same time, it is coupled to driving means from the drive source of the main body of the apparatus. By the developing sleeve receiving the application of the bias and rotative driving as described above, the electrostatic latent images on the electrophotographic photosensitive body are developed and toner images are formed.

This developing device is provided with the developing sleeve bearing a toner thereon, a developing blade which is a regulating member adapted to be urged against the outer peripheral surface of the developing sleeve and regulate the thickness of the coat layer of the toner borne on the developing sleeve, and an end seal as a leakage preventing member for preventing the leakage of the toner disposed at the opposite sides of an opening in a developing container for supplying the toner to the developing sleeve.

The opposite ends of the developing blade are of an obliquely cut shape, and a portion of the obliquely cut portion is disposed in overlapping relationship with the aforedescribed end seal. This end seal is stuck on the opposite sides of the opening in the developing container along the circumference of the developing sleeve, and is urged against the developing sleeve with a predetermined amount of crushing to thereby prevent the leakage of the toner to the outside of the toner.

In the above-described prior-art construction, however, that portion of the developing blade which overlaps the end seal, as compared with the other portions, becomes high in the abutting pressure with the developing sleeve by an amount corresponding to the repulsive force by the end seal being crushed. Thereby, the abutting pressure of the developing blade is not uniform and therefore, the developing blade causes minute waving deformation in the lengthwise direction thereof or because of the greater pressure of contact of the developing blade than necessary, the cohesion of the toner is liable to be caused and further, the coherer may be fused on the developing blade and disturb the coat on the developing sleeve, whereby the toner coat layer on the developing sleeve may become non-uniform and good image formation may not be accomplished.

SUMMARY OF THE INVENTION

So, it is an object of the present invention to mitigate the abutting pressure of a developer regulating member at an end portion so that the abutting pressure of the developer regulating member with a developer bearing body may become more uniform in the entire area in the lengthwise direction thereof.

It is another object of the present invention to provide a developing apparatus in which a force with which an end portion leakage preventing member presses a regulating member is alleviated.

DESCRIPTION OF THE PREFERRED EMBODIMENTS

An embodiment of an electrophotographic image forming apparatus to which the present invention is applied will hereinafter be specifically described with reference to the drawings. In the ensuring description, a color electrophotographic image forming apparatus on which a developing apparatus to which the present invention is applied is detachably attachable will be exemplified and described.

[General Construction of the Electrophotographic Image Forming Apparatus]

Figure 1:
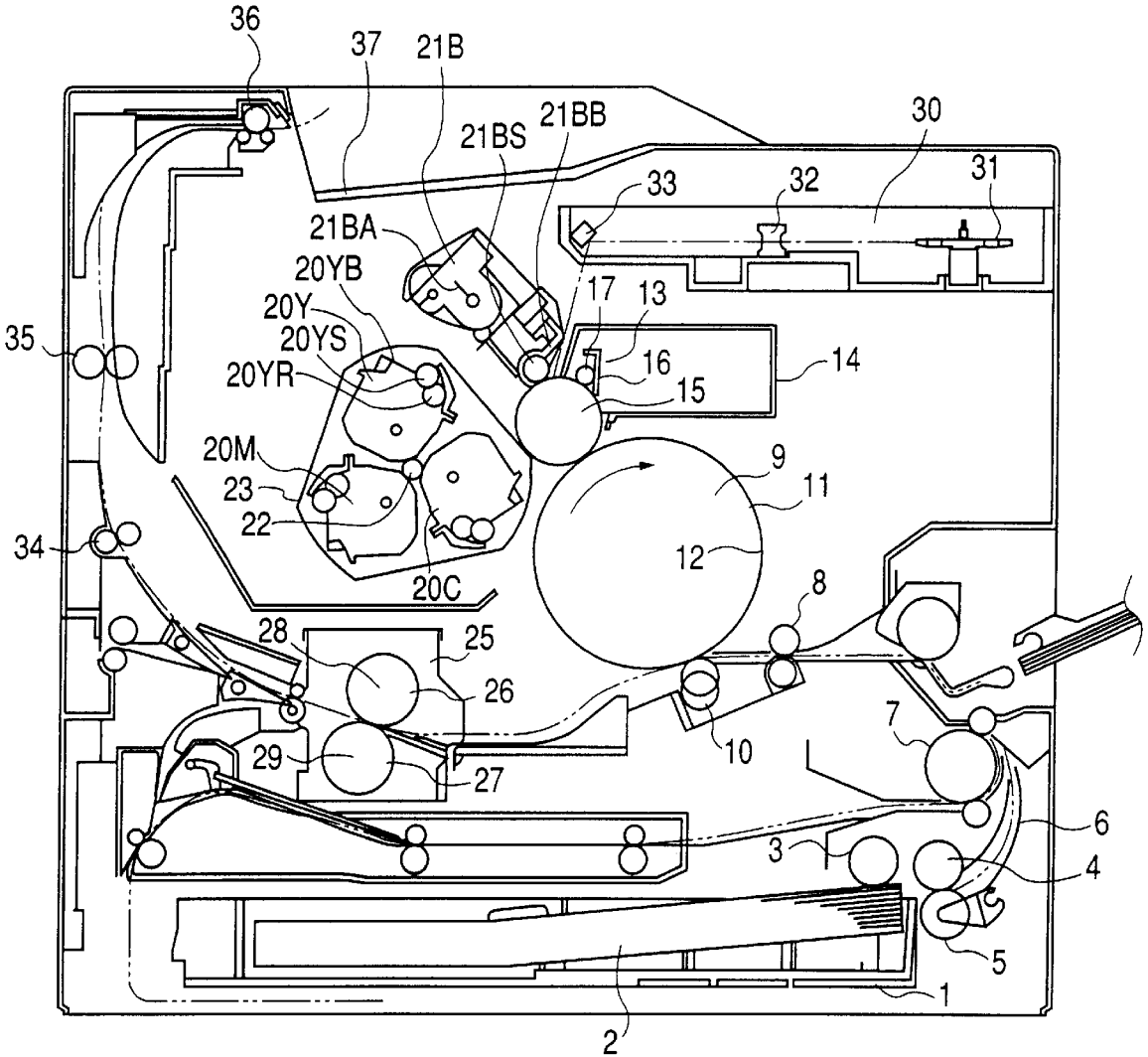
FIG. 1 is an illustration of the general construction of a color laser printer which is a form of a color electrophotographic image forming apparatus.

The general construction of the color electrophotographic image forming apparatus will first be schematically described with reference to FIG. 1. FIG. 1 is an illustration of the general construction of a color laser printer which is a form of the color electrophotographic image forming apparatus.

The image forming portion of the color laser printer is comprised of an electrophotographic photosensitive body (photosensitive drum) 15 rotatable at a constant speed, a fixed type black developing device 21B, and three rotatable color developing devices (a yellow developing device 20Y, a magenta developing device 20M and a cyan developing device 20C).

Below the image forming portion, there is disposed an intermediate transfer body 9 for holding a developed and multiplexly copied color image and further transferring it to a transfer material 2 fed from a feeding portion.

The transfer material 2 to which the color image has been transferred is then conveyed to a fixing portion 25, whereby the color image is fixed on the transfer material 2, which is then discharged to a discharging portion 37 on the upper surface of the apparatus by discharge rollers 34, 35 and 36.

The rotatable color developing devices and the fixed type black developing device are individually detachably attachable to the main body of the printer.

The construction of each portion of the electrophotographic image forming apparatus will now be described in detail.

[Electrophotographic Photosensitive Body Unit]

An electrophotographic photosensitive body unit 13 as a process cartridge comprises an electrophotographic photosensitive body (photosensitive drum) 15 which is an image bearing body and is made integral with a container 14 for cleaning means which serves also as the holder of the electrophotographic photosensitive body 15. This electrophotographic photosensitive body unit 13 is supported detachably with respect to the main body of the printer and is designed to be easily interchangeable in accordance with the service life of the electrophotographic photosensitive body 15.

The electrophotographic photosensitive body 15 according to the present embodiment is comprised of an aluminum cylinder having a diameter of about 62 mm and an organic photoconductive material layer applied to the outer side thereof, and is rotatably supported on the container 14 for the cleaning means which serves also as the holder of the electrophotographic photosensitive body 15.

A cleaning blade 16 and primary charging means 17 are disposed on the periphery of the electrophotographic photosensitive body 15, and the drive force of a driving motor, not shown, may be transmitted to a rear end as viewed in FIG. 1 to thereby rotate the electrophotographic photosensitive body 15 counter-clockwisely in conformity with the image forming operation.

[Charging Means]

The charging-means 17 uses a contact charging method, and is adapted to abut a charging roller against the electrophotographic photosensitive body 15, and uniformly charge the surface of the electrophotographic photosensitive body 15 by applying a voltage to the charging roller.

[Exposure Means]

The exposure of the electrophotographic photosensitive body 15 is effected from a scanner portion 30. That is, when an image signal is given to a laser diode, this laser diode applies image light corresponding to the image signal to a polygon mirror 31.

This polygon mirror 31 is rotated at a high speed by a scanner motor, and the surface of the electrophotographic photosensitive body 15 rotated at a constant speed is selectively exposed to the image light reflected by the polygon mirror 31, through an imaging lens 32 and a reflecting mirror 33 and as the result, an electrostatic latent image is formed on the electrophotographic photosensitive body 15.

[Developing Means]

Developing means is comprised of three rotatable developing devices 20Y, 20M and 20C and a black developing device 21B which can effect the development of respective colors, i.e., yellow, magenta, cyan and black, to visualize the electrostatic latent image.

The black developing device 21B is a fixed developing device, and a developing sleeve 21BS is disposed at a position opposed to the electrophotographic photosensitive body 15 with a minute spacing (about 300 $\mu$m) therebetween, and a developing bias is applied to the developing sleeve 21BS to thereby effect reversal developing (jumping developing) correspondingly to the electrostatic latent image on the electrophotographic photosensitive body 15, whereby the latent image is visualized as a toner image on the surface of the electrophotographic photosensitive body 15.

The toner capacity of the black developing device 21B, in view of documents and image patterns handled by a user and the amount of toner consumption, corresponds to 15,000 pages (A4 printed by 5%) more than two times the toner capacity of the other color developing devices 20Y, 20M and 20C.

The black developing device 21B is made great in its capacity as described above, whereby the frequency with which the user interchanges the black developing device 21B is reduced and it also becomes possible to reduce the running cost per sheet of print.

Also, the disposed position of the black developing device 21B is located between the scanner portion 30 which is the exposure means and the color developing devices 20Y, 20M, 20C which are the rotatable developing devices, as shown in FIG. 1, whereby the toners leaking when the color developing devices 20Y, 20M and 20C are rotated are prevented from scattering to the optical parts or the like of the scanner portion. Thereby, the toners can be prevented from adhering to the polygon mirror, the imaging lens, the reflecting mirror, etc. to thereby hamper image formation, and a clear-cut output image can be obtained.

Each of three rotatable developing devices 20Y, 20M and 20C contains a toner corresponding in quantity to 6,000 pages (A4, printed by 5%), and is held detachably attachable on a developing rotary 23 rotatable about a shaft 22.

During image formation, each developing device is rotatively moved about the shaft 22 while being held on the developing rotary 23, and predetermined one of the developing devices stays at a position opposed to the electrophotographic photosensitive body 15 and further, the developing sleeve is positioned so as to be opposed to the electrophotographic photosensitive body 15 with a minute spacing (about 300 $\mu$m) therebetween, whereafter a visible image is formed correspondingly to the electrostatic latent image on the electrophotographic photosensitive body 15.

During color image formation, the developing rotary 23 is rotated for each one full rotation of the intermediate transfer body 9, and the developing step is executed by the yellow developing device 20Y, the magenta developing device 20M, the cyan developing device 20C and the black developing device 21B in the named order.

In FIG. 1, there is shown a state in which the yellow rotatable developing device 20Y is positioned and rests at a position opposed to the electrophotographic photosensitive body unit 13. The rotatable developing device 20Y feeds a toner onto an applying roller YR by a toner feeding mechanism in the container. The applying roller 20YR rotated clockwisely as viewed in FIG. 1 and a developing blade 20YB urged against the outer periphery of the developing sleeve 20YS regulate the layer thickness of the toner on the outer periphery of the developing sleeve 20YS rotated clockwisely as viewed in FIG. 1, apply the toner in the form of a thin layer, and impart charges (frictional charges) to the toner.

A developing bias is applied to the developing sleeve 20YS opposed to the electrophotographic photosensitive body 15 on which the latent image is formed, whereby toner development is effected on the electrophotographic photosensitive body 15 in conformity with the latent image.

With regard also to the magenta developing device 20M and the cyan developing device 20C, toner development is effected by a mechanism similar to what has been described above.

Also, the respective developing sleeves of the rotatable developing devices 20Y, 20M and 20C are connected to high voltage sources and drive sources for respective colors provided in the main body of the printer when the respective developing devices are rotatively moved to the developing position, and during each color development, a voltage is selectively applied and the drive source is connected.

[Intermediate Transfer Body]

During color image formation, the intermediate transfer body 9 is rotated clockwisely as viewed in FIG. 1 in synchronism with the outer peripheral velocity of the electrophotographic photosensitive body 15 in order to receive the multiplex transfer of the toner images on the electrophotographic photosensitive body 15 visualized by the respective developing devices four times (the images of four colors Y, M, C and B). Also, the intermediate transfer body 9 which has received the multiplex transfer cooperates with a transfer roller 10 to which a voltage has been applied to sandwich the transfer material 2 therebetween and convey it, whereby the respective color toner images on the intermediate transfer body 9 are multiplexly transferred to the transfer material 2 at a time.

The intermediate transfer body 9 in the present embodiment is comprised of an aluminum cylinder 12 having a diameter of 186 mm and an elastic layer 11 such as medium resistance sponge or medium resistance rubber covering the outer periphery of the aluminum cylinder 12. This intermediate transfer body 9 is driven and rotated by a rotatably supported and integrally fixed gear (not shown).

[Cleaning Means]

Cleaning means removes any toners remaining on the electrophotographic photosensitive body 15 after the toner images visualized on the electrophotographic photosensitive body 15 by the developing means have been transferred to the intermediate transfer body 9. Thereafter, the removed waste toners are stored in a container 14. The quantity of the waste toners stored in the container 14 does not fill the container 14 earlier than the life of the electrophotographic photosensitive body 15 and accordingly, the container 14 is interchanged simultaneously and integrally with the interchange of the electrophotographic photosensitive body 15.

[Feeding Portion]

The feeding portion feeds the transfer material 2 to the image forming portion, and is comprised chiefly of a cassette 1 containing a plurality of transfer materials 2 therein, a pickup roller 3, a feed roller 4, a retard roller 5 for preventing double feeding, a feed guide 6, registration rollers 8, etc.

During image formation, the pickup roller 3, the feed roller 4 and the retard roller 5 are rotatively driven in conformity with the image forming operation to thereby separate and feed the transfer materials 2 in the cassette 1 one by one and guide the transfer materials 2 by the guide 6, and the transfer materials 2 come to the registration rollers 8 via a conveying roller 7.

During the image forming operation, the registration rollers 8 effect the non-rotating operation of causing the transfer material 2 to rest and wait and the rotating operation of conveying the transfer material 2 toward the intermediate transfer body 9, at a predetermined sequence, and effect the alignment between the image and the transfer material during the transfer step which is the next step.

[Transfer Portion]

The transfer portion comprises a pivotally movable transfer roller 10 which comprises a metallic shaft having a medium resistance foamed elastic material wound thereon, and is vertically movable and has a drive source.

During the time when toner images of four colors are formed on the intermediate transfer body 9, i.e., during the time when the intermediate transfer body 9 effects a plurality of full rotations, the transfer roller 10 is positioned below and is separate from the intermediate transfer body 9, as indicated by solid line in FIG. 1 so as not to disturb the images.

After the toner images of four colors have been formed on the intermediate transfer body 9, the transfer roller 10 is urged toward an upper position indicated by thin line, i.e., against the intermediate transfer body 9 via the transfer material 2 by a cam member, not shown, with predetermined pressure in synchronism with the timing at which the color images are transferred to the transfer material 2. At the same time, a bias is applied to the transfer roller 10 and the toner images on the intermediate transfer body 9 are transferred to the transfer material 2.

Since the intermediate transfer body 9 and the transfer roller 10 are driven respectively, the transfer material 2 sandwiched between the two is conveyed leftwardly at a predetermined speed as viewed in FIG. 1 as soon as the transferring step is effected, and is sent toward a fixing portion 25 which is the next step.

[Fixing Portion]

The fixing portion 25 fixes the toner image formed on the transfer material through the intermediate transfer body 9 after the toner images have been formed by the developing means 20, 21. As shown in FIG. 1, the fixing portion 25 comprises a fixing roller 26 for applying heat to the transfer material 2, and a pressing roller 27 for urging the transfer material 2 against the fixing roller 26, and each of these rollers is a hollow roller. Heaters 28 and 29 are provided in the respective rollers, and the rollers are designed to be rotatively driven and convey the transfer material 2 at the same time.

That is, the transfer material 2 holding the toner image thereon is conveyed by the fixing roller 26 and the pressing roller 27 and has heat and pressure applied thereto, whereby the toners are fixed on the transfer material 2.

[Construction of the Color Developing Devices]

Figure 2:
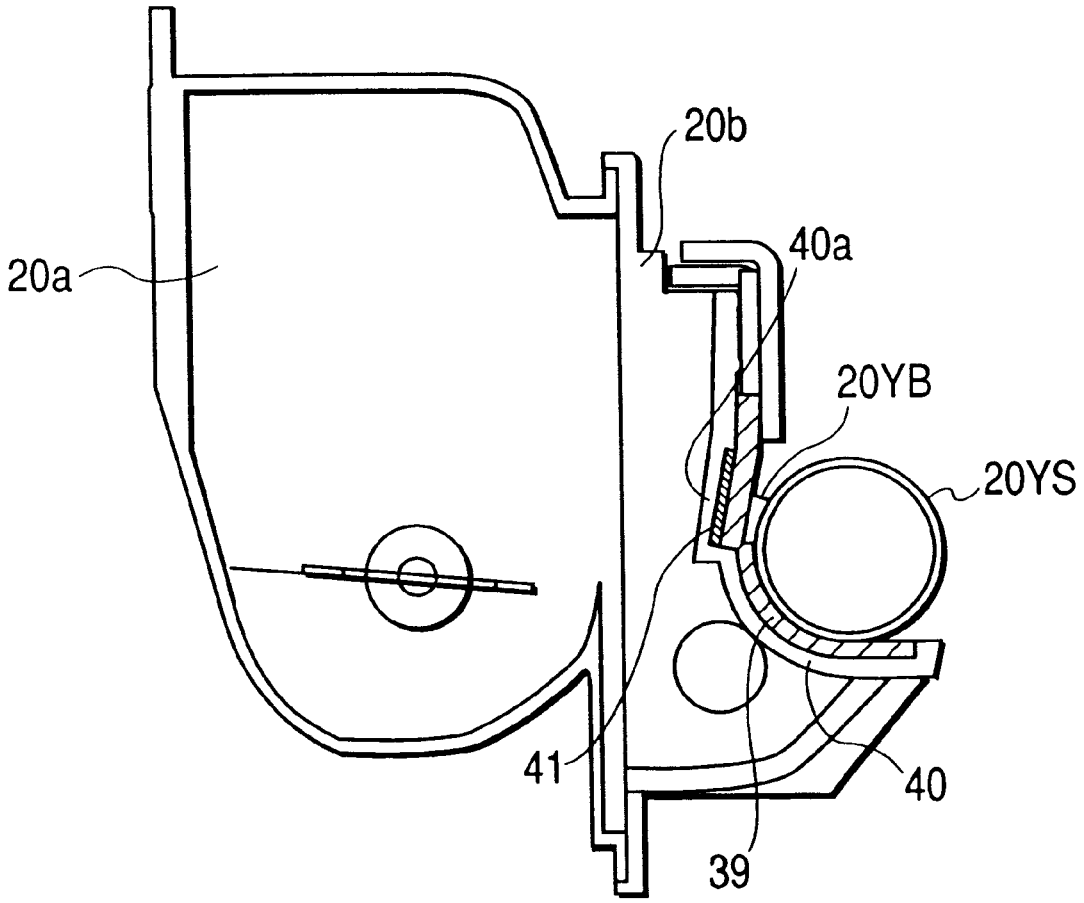
FIG. 2 schematically shows the cross-sectional construction of a rotatable developing device.
Figure 3:
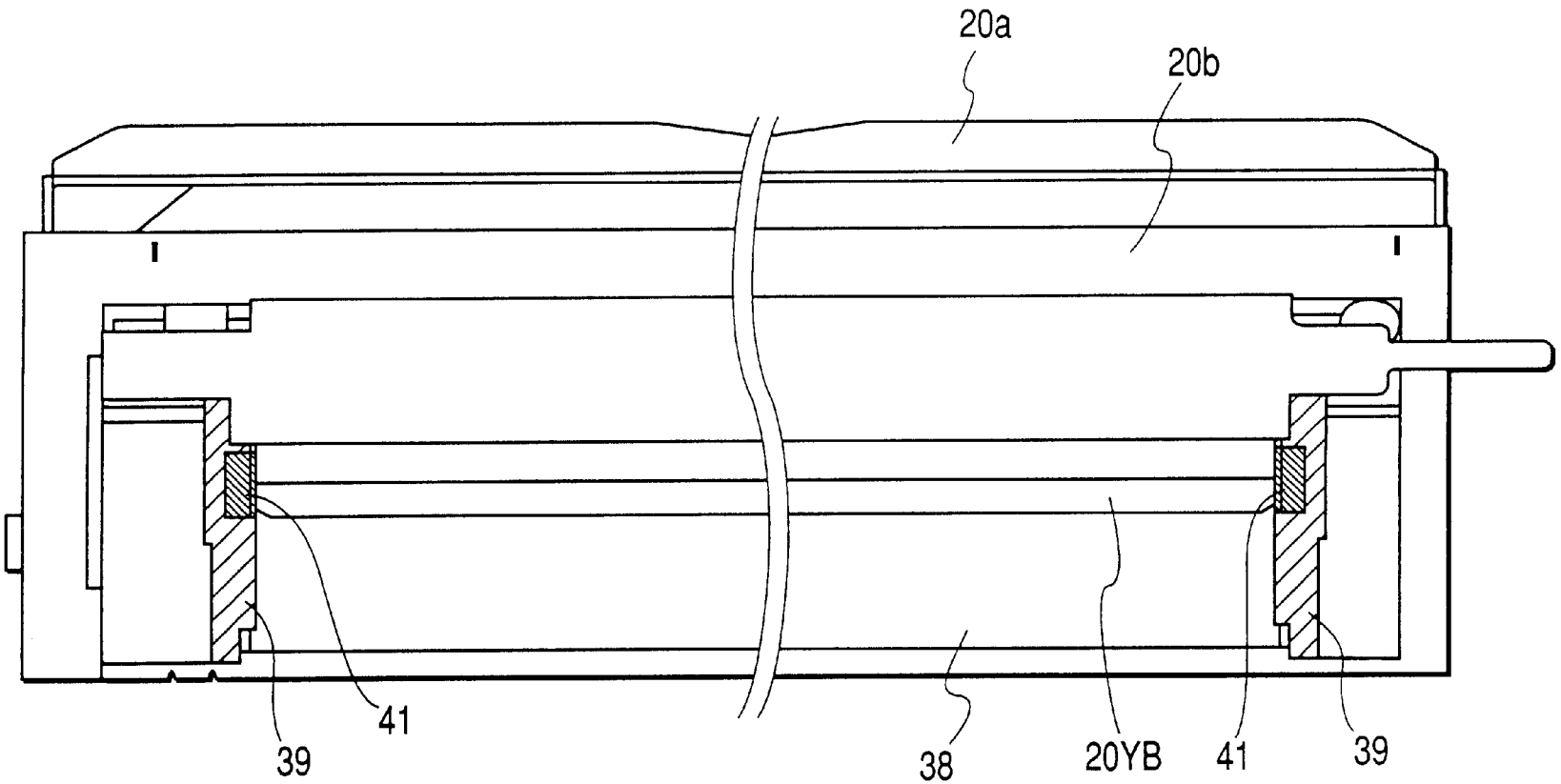
FIG. 3 schematically shows the construction of the rotatable developing device as it is seen from its front.

Reference is now had to FIGS. 2 and 3 to describe the construction of the rotatable developing devices which are the color developing devices in detail by the use of the yellow developing device. FIG. 2 schematically shows the cross-sectional construction of the rotatable developing device, and FIG. 3 schematically shows the construction of the rotatable developing device as it is seen from its front.

The rotatable developing device has a toner container 20*a* containing a toner therein, and a developing container 20*b* having an opening 38 for supplying the toner to a developing sleeve 20YS therethrough, the toner container 20*a* and the developing container 20*b* being coupled together by welding, and is comprised of the developing sleeve 20YS, a developing blade 20YB, an applying roller 20YR, etc. An end seal 39 as a member for preventing the leakage of the developer is provided at each end of the opening in the developing container 20*b,* and is urged against the developing sleeve 20YS with a predetermined amount of crushing so that the toner may not leak to the outside of the opposite ends of the opening. The end seal 39 is of two-layer structure in which the overlying layer thereof which contacts with the developing sleeve 20YS comprises Teflon felt or Teflon pile and the underlying layer thereof is an elastic material such as wool felt or Poron (sold by INOAC corporation).

The developing blade 20YB is an elastic rubber blade having its lengthwise opposite ends of an obliquely cut shape, and a portion of this obliquely cut portion is lengthwisely disposed so as to overlap the end seal 39.

The seal surface 40 of the developing container 20*b* on which the end seals 39 are stuck is of a shape along the outer peripheral surface of the developing sleeve 20YS, and that portion thereof which the developing blade 20YB overlaps is formed with a recess 40*a*. In the recess 40*a,* there is provided an elastic member 41 such as Moltopren (sold by INOAC corporation) softer than the end seals 39. That is, when the elastic member 41 and the end seals 39 receive the same load force, the elastic member 41 is greater in the amount of deformation than the end seals 39.

This elastic member 41 forms a portion of the seat surface 40 on which the end seals 39 are stuck with a constant amount of crushing by the end seals 39, prevents the entry of the toner, absorbs the crushing of the end seals 39 by the flexure of the developing blade 20YB, and alleviates the repulsive force of the end seals toward the developing blade 20YB.

As described above, the seat surface 40 on which the end seals 39 are stuck in that portion which the developing blade

20YB overlaps is formed by the elastic member 41, whereby the abutting pressure with the developing sleeve 20YS by the repulsive force of the end seals in the opposite end portions of the developing blade 20YB is mitigated. It will suffice if the elastic member 41 is present on at least a part of the overlapping portion between the end seals 39 and the blade 20YB. It is preferable that particularly the elastic member 41 be provided so as to overlap the overlapping portion between the end seals 39 and the free end of the blade 20YB.

Also, the elastic member 41 uses a material having elasticity softer than the end seals 39 and therefore, the elastic member 41 is crushed more positively than the end seals 39 and the repulsive force of the end seals 39 is more alleviated, and this is further effective to mitigate the pressure of contact of the opposite end portions of the developing blade 20YB with the developing sleeve 20YS.

While in the present embodiment, the color rotatable developing devices detachably attachable to the main body of the apparatus have been exemplified and described, the present invention is not restricted thereto, but a similar effect is also obtained, for example, in the black developing device detachably attachable to the main body of the apparatus. Or a similar effect is also obtained in developing devices of a type fixed to the main body of the apparatus.

Also in a process cartridge detachably attachable to the main body of the apparatus and having an electrophotographic photosensitive body which is an image bearing body and developing means as process means acting thereon, the present invention can be applied to thereby obtain a similar effect.

While a printer has been exemplified as the electrophotographic image forming apparatus, the present invention is not restricted thereto, but may be other electrophotographic image forming apparatus such as a copying apparatus or a facsimile apparatus, and further the present invention is not restricted to a color type electrophotographic image forming apparatus, but can also obtain a similar effect in a monochromatic type electrophotographic image forming apparatus.

As described above, the end seal is provided on each of the lengthwisely opposite ends of the opening in the developing container and at least a portion of the seat surface of the developing container on which the end seals are stuck is formed by an elastic member and more specifically, the end seals overlap the developer regulating member, and at least that portion of the seat surface of the developing container on which the end seals are stuck which overlaps the developer regulating member is formed by the elastic member and therefore, in that portion of the developer regulating member which overlaps the end seals on the lengthwisely opposite ends, the repulsive force of the end seals is alleviated by the elastic member on the seat surface on which the end seals are stuck, and the pressure of contact of the opposite end portions of the developer regulating member with the developer bearing body is mitigated, whereby uniform pressure of contact can be provided in the entire lengthwise area.

Further, the elastic member is made into a member having elasticity softer than the end seals, whereby the elastic member is crushed more positively than the end seals and the repulsive force of the end seals is more alleviated, and this is further effective to mitigate the pressure of contact of the opposite end portions of the developer regulating member with the developer bearing body.

Thereby, a uniform developer coat layer can be formed on the developer bearing body without waving the developer regulating member and without causing the cohesion of the developer, and good image formation can be accomplished.

What is claimed is:

1. A developing apparatus comprising:

a developing container provided with an opening portion;

a developer bearing body, provided in said opening portion, for bearing and conveying a developer;

a developer regulating member for regulating a thickness of a layer of the developer on said developer bearing body;

a leakage preventing member, supported on an end portion in a lengthwise direction of said developing container, for preventing leakage of the developer, said leakage preventing member cooperating with said developer bearing body to sandwich said developer regulating member therebetween; and an elastic member provided on a side of said leakage preventing member which is supported by said developing container, said elastic member being provided so as to overlap an overlapping portion between said leakage preventing member and said developer regulating member on said end portion in the lengthwise direction.

2. A developing apparatus according to claim 1, wherein said elastic member has elasticity softer than said leakage preventing member.

3. A developing apparatus according to claim 1, wherein said overlapping portion extends between said leakage preventing member and a free end of said developer regulating member.

4. A developing apparatus according to any one of claims 1 to 3, wherein said developing apparatus, together with an image bearing body, constitutes a process cartridge detachably attachable to an image forming apparatus.

* * * * *

UNITED STATES PATENT AND TRADEMARK OFFICE

CERTIFICATE OF CORRECTION

PATENT NO. : 6,185,392 B1
DATED : February 6, 2001
INVENTOR(S) : Nobuharu Hoshi

It is certified that error appears in the above-identified patent and that said Letters Patent is hereby corrected as shown below:

Column 2,
Line 34, "printer" should read -- printer, --.

Column 3,
Line 16, "counter-clockwisely" should read -- in a counter-clockwise direction --;
Line 19, "charging-means" should read -- charging means --;
Line 38, "Developing" should read -- A developing --; and
Line 66, "30" should read -- 30, --.

Column 4,
Lines 35, 39 and 60, "clockwisely" should read -- in a clockwise direction --;

Column 5,
Line 13, "Cleaining" should read -- A cleaning --; and
Line 54, "by" should read -- by a --.

Column 6,
Line 1, "leftwardly" should read -- toward the left --; and
Line 21, "had" should read -- made --.

Column 8,
After line 50, the following claims 5-9 should be added:

--5. A developing apparatus comprising:

a developing container provided with an opening portion;

a developer bearing body, provided in said opening portion, for bearing and conveying a developer;

a developer regulating member for regulating a thickness of a layer of the developer on said developer bearing body;

a leakage preventing member, supported on an end portion in a lengthwise direction of said developing container, for preventing leakage of the developer, said leakage preventing member being provided with an overlapping portion, which overlaps said developer regulating member and a nonoverlapping portion, which does not overlap said developer regulating member, said overlapping portion cooperating with said developer bearing body to sandwich said developer regulating member therebetween, and said developing container being provided with a concave portion at a position corresponding to said overlapping portion; and an elastic member provided on a side of said leakage preventing member, which is supported by said developing container, and said elastic member being provided on said concave portion.

UNITED STATES PATENT AND TRADEMARK OFFICE

CERTIFICATE OF CORRECTION

PATENT NO. : 6,185,392 B1
DATED : February 6, 2001
INVENTOR(S) : Nobuharu Hoshi

It is certified that error appears in the above-identified patent and that said Letters Patent is hereby corrected as shown below:

Column 8 (cont'd),

6. A developing apparatus according to Claim 5, wherein said nonoverlapping portion extends from said overlapping portion along a rotating direction of said developer bearing body.

7. A developing apparatus according to Claim 5, wherein said nonoverlapping portion extends outwardly in said lengthwise direction from said overlapping portion.

8. A developing apparatus according to Claim 5, wherein said elastic member has elasticity softer than said leakage preventing member and said overlapping portion extends to a free end of said developer regulating member.

9. A developing apparatus according to any one of Claims 5 to 8, wherein said developing apparatus, together with an image bearing body, constitutes a process cartridge detachably attachable to an image forming apparatus.--

Signed and Sealed this

Twenty-eighth Day of June, 2005

JON W. DUDAS
*Director of the United States Patent and Trademark Office*